United States Patent [19]

Borsari et al.

[11] Patent Number: 4,692,589

[45] Date of Patent: Sep. 8, 1987

[54] ELECTRIC IRON HAVING SAFETY CUTOFF SWITCH AND TEMPERATURE INDICATOR

[75] Inventors: Allen S. Borsari, Hamden; Stanley J. Brym, Torrington, both of Conn.; Laura A. Markure, Framingham, Mass.; Ronald G. Arpino, Branford, Conn.

[73] Assignee: Hamilton Beach Inc., Waterbury, Conn.

[21] Appl. No.: 826,228

[22] Filed: Feb. 5, 1986

[51] Int. Cl.[4] ..... H05B 1/02

[52] U.S. Cl. ..... 219/251

[58] Field of Search ..... 219/245–259

[56] References Cited

U.S. PATENT DOCUMENTS

| | | | |
|---|---|---|---|
| 2,833,903 | 5/1958 | Waddell | 219/251 X |
| 2,970,394 | 2/1961 | Brumbaugh | 219/255 X |
| 4,347,428 | 8/1982 | Conrad et al. | 219/251 |

FOREIGN PATENT DOCUMENTS

| | | | |
|---|---|---|---|
| WO82/03520 | 10/1982 | PCT Int'l Appl. | 219/251 |
| 2158105 | 11/1985 | United Kingdom | 219/250 |

*Primary Examiner*—Donald A. Griffin

*Attorney, Agent, or Firm*—Dallett Hoopes

[57] ABSTRACT

An electric iron is provided with an orientation-detecting switch and a timing circuit, which, after the iron is unmoved in the horizontal or vertical positions for preset times, respectively, activates a heating resistor in the iron to trigger a manually resettable thermostatic cutoff switch. The iron also includes a temperature-sensing resistor and a potentiometer in circuit with a comparator and indicator means, whereby when the temperature reaches a level to which the potentiometer is set, the indicator means indicate that the iron is at ready temperature.

6 Claims, 5 Drawing Figures

ELECTRIC IRON HAVING SAFETY CUTOFF SWITCH AND TEMPERATURE INDICATOR

BACKGROUND OF THE INVENTION 1. Field of the Invention

This invention relates to an electric pressing iron. More specifically, this invention relates to an electric pressing iron having means for shutting off the power to the iron should the iron be permitted to remain stationary either in the horizontal or the resting position for an inordinate amount of time. The invention further relates to such an iron having signaling means adapted to tell when the iron is at its preset temperature and when the power is on.

2. Description of the Prior Art

The prior art includes several earlier patents for shutting off an electric iron if the iron is not moved within a certain preset time period. Examples are U.S. Pat. No. 4,203,101 which issued May 13, 1980 to Townsend and which discloses an iron having sensing means in the handle sensitive to the pressure of the operator's hand. The sensing means are connected to timing means which deactivate the iron after a certain period. Also, U.S. Pat. No. 4,347,428 which issued Aug. 13, 1982 to Conrad et al discloses an iron having LED readouts for indicating the temperature of the soleplate.

SUMMARY OF THE INVENTION

The present invention provides a control circuit including a mercury switch, a timing circuit and a manually resettable thermostatic cutoff switch actuated by a heating resistor. The resettable thermostatic switch is in series with the main heating element of the iron. When the iron is not moved for a period of time, the heating resistor is energized to open the manually resettable thermostatic cutoff switch to shut down the iron and the control circuit.

Additionally, in the control circuit are a temperature-sensing resistor, a potentiometer mechanically coupled with the conventional iron temperature-regulating thermostat, a comparator circuit and indicating lights which indicate both when the iron is at proper temperature and warning when the heating resistor is being energized to open the thermostatic cutoff switch.

BRIEF DESCRIPTION OF THE DRAWINGS

Further objects and features of the invention will be understood from the following specification and the attached drawings, all of which disclose a non-limiting embodiment of the invention. In the drawings.

DETAILED DESCRIPTION OF THE PREFERRED EMBODIMENT

Figure 1:
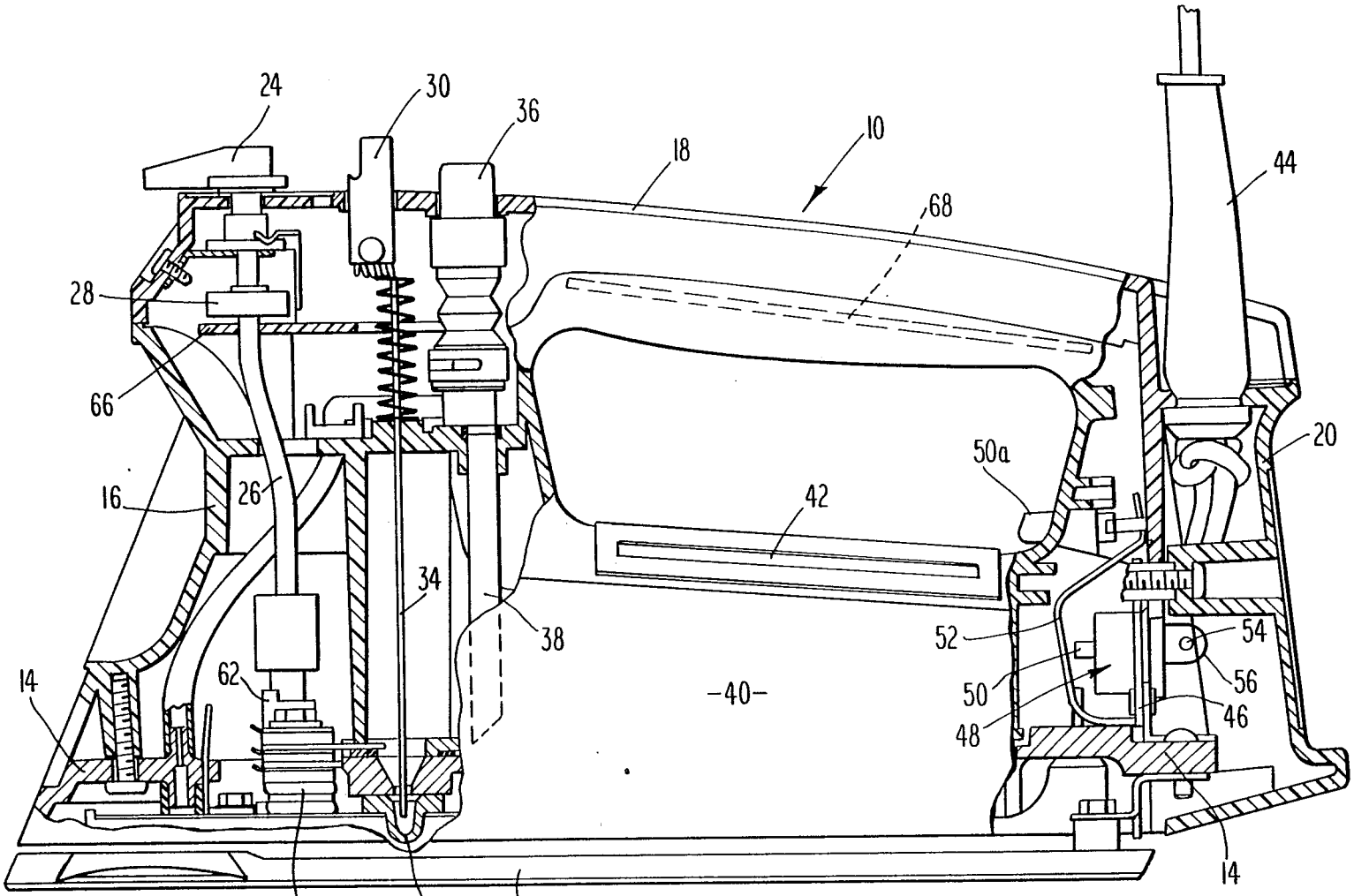
FIG. 1 is a side elevational view partly in section of an iron embodying the invention.

Referring more specifically to the drawings, an iron embodying the invention is generally designated 10 in FIG. 1. It comprises a soleplate 12, a soleplate cover 14, a plastic housing 16, a plastic upper section 18 and an end panel 20. Mounted on the soleplate is a conventional manually adjustable, temperature-regulating thermostat 22 which may be set by an exterior control knob 24 through an appropriate driving shaft 26. A potentiometer 28 is mounted on the shaft and mechanically coupled for rotation therewith.

A steam control button 30 operates the conventional steam control valve 32 through the rod 34. A burst steam/spray pump 36 is provided with a dip tube 38 into the water tank 40. A liquid level indicator 42 is mounted in the tank.

Power is supplied to the iron by a cord 44 which enters the iron through the rear panel 20. A heating element (not shown) is, of course, molded into the soleplate 12.

Mounted at the rear of the iron on the soleplate cover 14 is the thermostat board 46. The board is apertured and fixedly supports the manually resettable thermostat unit 48 having the reset pin 50. The resettable thermostatic unit 48 is of the conventional disc type being calibrated to open the main heating element electric circuit at about 320° F. in the preferred version. Also mounted on the board is the actuator arm 52 which extends upwardly and inwardly and is operable exteriorly of the iron by the reset button 50*a* extending through an opening in the iron housing as can be seen. Depression of the button 50*a* rightwardly (FIG. 1) urges the arm 52 rightwardly to depress the reset pin 50.

Figure 2:
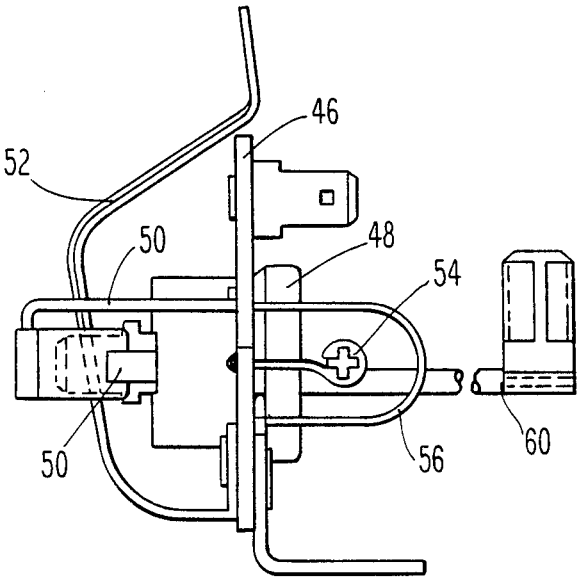
FIG. 2 is a side elevational view of the rear thermostat board.

FIG. 2 shows in some detail the thermostat board 46 and the resettable thermostatic unit 48 as well as the arm 52 and reset pin 50.

Mounted on the board 46 at the rear of the thermostat is the wire-wound heating resistor 54 which is covered by heat reflective shield 56. Leads 60 connect the resettable thermostatic unit 48 with other components of the circuit (not shown). A temperature-sensing resistor 62 is disposed on thermostat 22, so as to be responsive to temperature of the soleplate 12.

Other elements of the control circuit are disposed in the circuit board 66 at the forward end of the iron and a second circuit board 68 mounted in the handle of the iron (shown in phantom in FIG. 1).

The Iron Circuitry

Figure 4:
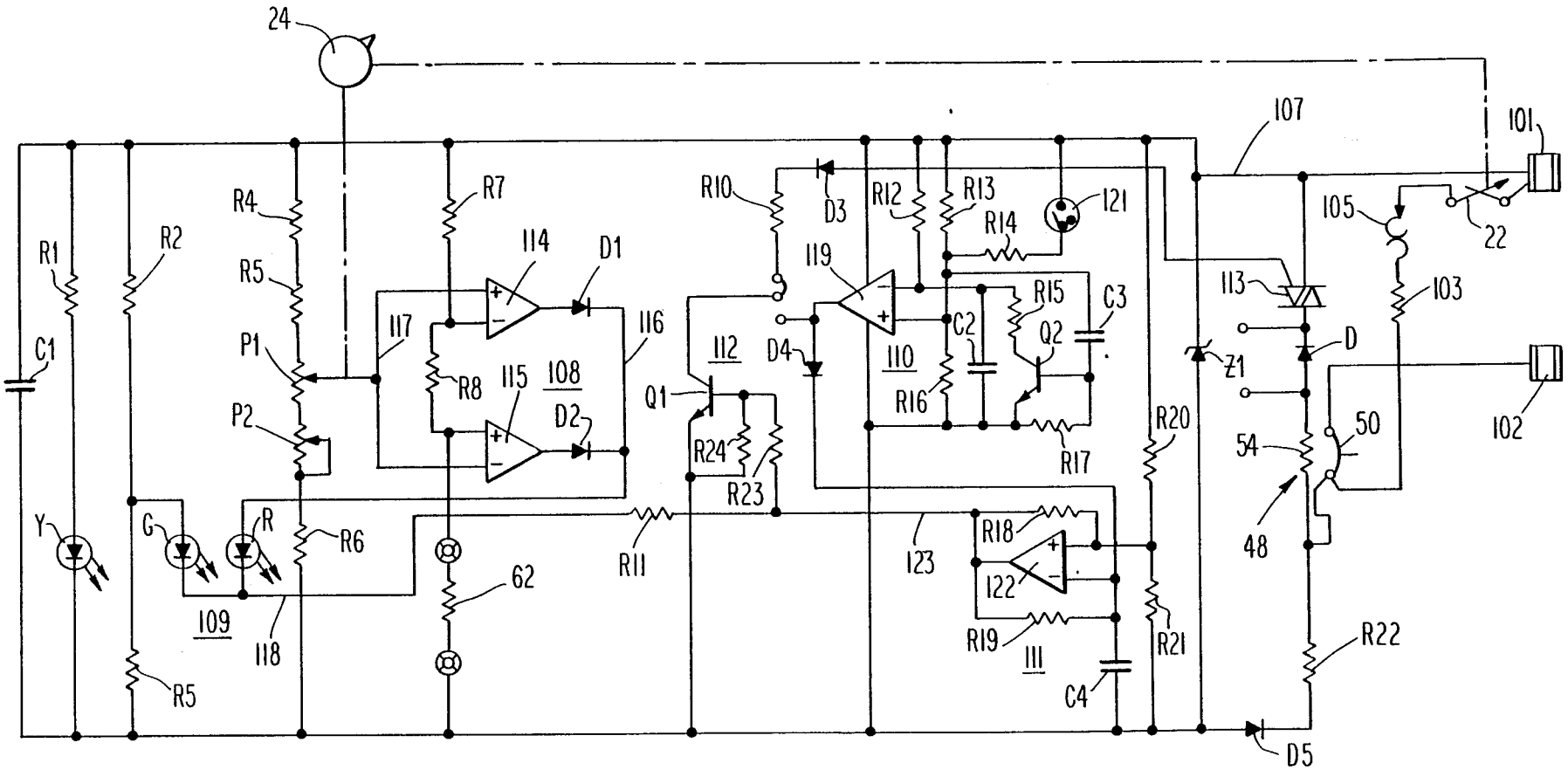
FIG. 4 is a schematic diagram of the control circuit of an iron embodying the invention.

The circuitry of an iron embodying the invention is shown schematically in FIG. 4. As shown, the line voltage delivered through the cord 44 is imposed across the terminals 101 and 102.

Terminals 101, 102 supply AC line current to a heating element 103 in the soleplate and also serve to power the control circuit, shown generally at 104.

Figure 3:
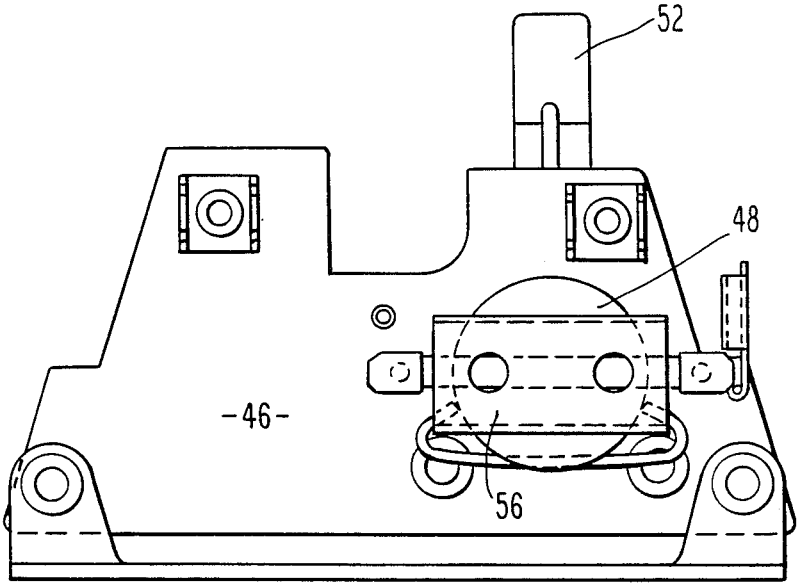
FIG. 3. is a rear elevational view of the thermostat board.

Elements depicted in the FIG. 4 control circuit having the same reference numerals as in previously described FIGS. 1–3 are the exterior control knob 24, the manually resettable thermostatic cutoff switch 48 with its heating resistor 54 and manual reset button 50*a*, the manually adjustable temperature-regulating thermostat 22, and the temperature-sensing resistor 62. Heating element 103 is connected in series both with the contacts of thermostat 22 and with the contacts of thermostatic cutoff switch 48 between the terminals 101, 102. A thermal fuse 105 may also be included in this circuit for safety. When the contacts of thermostatic cutoff switch 48 are closed, AC power is also applied to control circuit 104 through a dropping resistor R22 and diode D5, thereby supplying half-wave rectified voltage between a ground lead 106 and a positive lead 107.

Regulation of the DC voltage between leads 106, 107 at 24 volts is provided by a Zener diode Zl and a filter capacitor C1 (located at the left side of the drawing) connected across the leads. Presence of power on control circuit 104 is indicated by a yellow LED indicator Y connected in series with resistor R1 across leads 106, 107.

Control circuit 104, for purpose of analysis, may be broken down into several major functional components, which are generally indicated on the drawing as follows:

A comparator circuit 108, which is responsive both to the setting of control knob 24 and to the temperature sensed by resistor 62 in a manner to be described, has its output connected to an LED indicator circuit shown generally as 109. An orientation timer circuit, shown generally as 110, has its output connected to a pulse-generating circuit 111. Circuit 111 has outputs connected both to the indicator circuit 109 and to a thermostat-actuating circuit 112. The thermostat-actuating circuit 112 is connected to the gate of a triac 113. The elements of these major circuit components will now be described.

Comparator circuit 108 preferably consists of two operational amplifiers 114, 115 having their respective outputs connected through diode D1 and diode D2 to a common output lead 116. One input to amplifiers 114, 115 is from a voltage divider established across leads 106, 107 consisting of series-connected resistors R4, R5, adjustable potentiometer P1, trimmer potentiometer P2 and resistor R6. The slider of potentiometer P1 is connected through a common lead 117 to the non-inverting input of operational amplifier 114 and to the inverting input of operational amplifier 115.

A second input to the comparator circuit is from a voltage divider established through series-connected resistors R7, R8 and the temperature-sensing resistor 62. The arrangement of the foregoing circuit elements is sometimes known as a "zero-crossing detector" and provides a high output on lead 116 in a range of voltages which may be selected by potentiometer P1 through knob 24. The bandwidth of the range of voltages is established by the resistance R8.

The indicator circuit 109 consists of a green LED G, and a red LED R, having their cathodes connected to a common lead 118. The anode of G is connected to a fixed supply voltage established by a voltage divider R2 and R5, while the anode of R is connected to the output lead 116 of the comparator circuit. Lead 118 is connected through a resistor Rll, and R18 to a fixed voltage established by a voltage divider comprising resistors R20, R21. The arrangement of indicator circuit 109 is such that when a high voltage appears on lead 116 at the output of the comparator, R will light up, whereas when a low voltage appears on lead 116, G will light up.

The orientation timer circuit 110 employs an operational amplifier 119, having its non-inverting input connected to a reference lead 120 at a voltage established by the opening or closing of the contacts of a mercury switch 121. When the switch is open, the voltage on lead 120 is established by a voltage divider consisting of a resistor of larger value, R13, and when the switch is closed, a resistor of smaller value, R14; these resistors being connected together in parallel and in series with a resistor R16. Switch 121 is positioned in the iron so that the contacts are closed when it is in the vertical position, thereby causing the reference voltage at 120 to be at a higher value of around 12 volts due to the lower resistance of R14. When the iron is in a horizontal position and mercury switch 120 is open, the reference voltage at 120 is a lower value of around 1.2 volts determined by the larger resistance R13.

The inverting input of amplifier 119 is connected through a resistor R12 to lead 107 and through a capacitor C2 to lead 106. A circuit for discharging capacitor C2 comprises NPN transistor Q2 having its collector connected through a resistor R15 to one side of C2 and its emitter connected to the other side of C2. A bias resistor R17 is connected between the base and emitter of transistor Q2.

A capacitor C3 is connected on one side to the base of Q2 and on the other side to reference lead 121. A differentiation RC circuit is provided by C3 with the variable resistor due to the motion of the mercury switch, in conjunction with R13, R14, R16, and R17. The output of amplifier 119 is connected through a diode D4 to pulse-generating circuit 111.

The orientation timing circuit 110 is connected such that a new time interval commences each time that the mercury switch 120 breaks, as determined by changing the orientation of the iron to a horizontal or a vertical position. Capacitor C2 discharges through transistor Q2 each time the mercury switch breaks contact. This reestablishes the inverting input at ground, whereupon the voltage rises as established by the RC time constant. When the voltage on lead 121 reaches that at the inverting input, the output of amplifier 119 goes low. The charging rate of the RC circuit is the same in either case. The selected circuit components are such that there will be a low output from amplifier 119 either when the iron has been 40 seconds in the horizontal position or 8 minutes in the vertical position.

The pulse-generating circuit 111 comprises an operational amplifier 122 connected as a free-running multivibrator to provide a square wave output on lead 123 whenever it is not deactivated by a high input on a lead 124 from the orientation timing circuit 110. Lead 123 is connected through the resistor R18 to the non-inverting input of amplifier 122. Lead 124 is connected to the inverting input and to an RC feedback network comprising a capacitor C4 and a resistor R19. The frequency of the free-running multivibrator is determined by the values of resistor R18, R19, R21 and capacitor C4, and is preferably selected to have a frequency of approximately 1 Hz.

The thermostat actuating circuit 112 comprises a NPN transistor Q1 having its emitter connected to lead 106. The base of Q1 is connected to lead 123 through a resistor R23 and to the emitter through biasing resistor R24. The collector of Q1 is connected through resistor R10 and a diode D3 to the gate of triac 113. When the output on lead 123 goes high, Q1 gates triac 113 turning it on. When lead 123 goes low, triac 113 turns off.

Triac 113 is connected in series with a diode D6 and heating resistor 54, so that when triac 113 is successively gated by the square wave from pulse-generating circuit 111 acting in conjunction with the thermostat actuating circuit 112, the heating resistor 54 is subjected to a DC pulsed current. This causes the temperature to rise rapidly. At a preselected temperature of resistor 54, thermostatic cutoff switch 48 will be actuated and must again be reset with button 50 in order to reactivate the iron heating element 103 and the control circuit.

The arrangement shown providing pulsed D.C. current may be simplified in some cases by eliminating transistor Q1 and diode D6, increasing the resistance of resistor 54 and applying A.C. from the line to resistor 54. The pulsed circuit described, however, will improve time out and reset functions, and reduce component cost.

While not being bound to the particular circuit arrangements shown, or the value of the circuit components selected, the following are specific circuit components and values used in the preferred embodiment of the invention.

Operational amplifiers 114, 115, 119 and 122 may conveniently be furnished in a single integrated circuit chip in a quad comparator arrangement, using for example, Part LM324 manufactured by AMD, National Semiconductor, Motorola, Texas Instruments and others. Full descriptions of the comparator circuit (zero crossing detector) and pulse-generating circuit (free-running multivibrator) are found at pages 239 and 146, respectively, of *Electronic Design with Off-the-Shelf Integrated Circuits,* 2nd Ed., by Z. H. Meiksin and Philips C. Thackray.

The temperature-sensing resistor 62 is preferably a wire-wound, resistor, 500 ohm, with a linear positive temperature coefficient of approximatley 4500 PPM/° C.

The thermostat actuating heater 54 is also wire-wound 500 ohm, 10 watts, selected to be of low thermal mass so as to quickly respond to the pulsing current.

Triac 113 may be low power rated, here 10 watts, 120 volts. As opposed to many prior art shutdown arrangements for electronic irons, including the aforecited Conrad et al, U.S. Pat. No. 4,347,428, the triac 113 controls the main heating element but is not connected in series with it. Since the triac is only subjected to low A.C. or pulsed D.C. current passing through heater 54, it can be of a lower power rating and less expensive.

Other representative circuit component values are as follows:

| | | | |
|---|---|---|---|
| C1, C2 | 100mf | R7, R16 | 22k ohms |
| C3 | 1mF | R4 | 150k ohms |
| C4 | .01mf | R13 | 270k ohms |
| D1, D4 | IN914 | R18 | 330k ohms |
| D5, D6 | IN400 | R20, R21 | 470k ohms |
| R15 | 100 ohms | R12 | 470k ohms |
| R8 | 200 ohms | R19 | 22meg ohms |
| R2 | 1k ohms | R22 | 1.2K ohms |
| R6 | 1.8k ohms | Q1, Q2 | 2N2222A |
| R14, R24 | 2.7k ohms | Z1 | 24V, 1W Zener |
| R10 | 3.3k ohms | P2 | 500 ohms trimmer |
| R1 | 4.7k ohms | P1 | 5000 ohms |
| R3 | 6.8k ohms | | |
| R5 | 15k ohms | | |
| R23 | 18k ohms | | |

Figure 5:
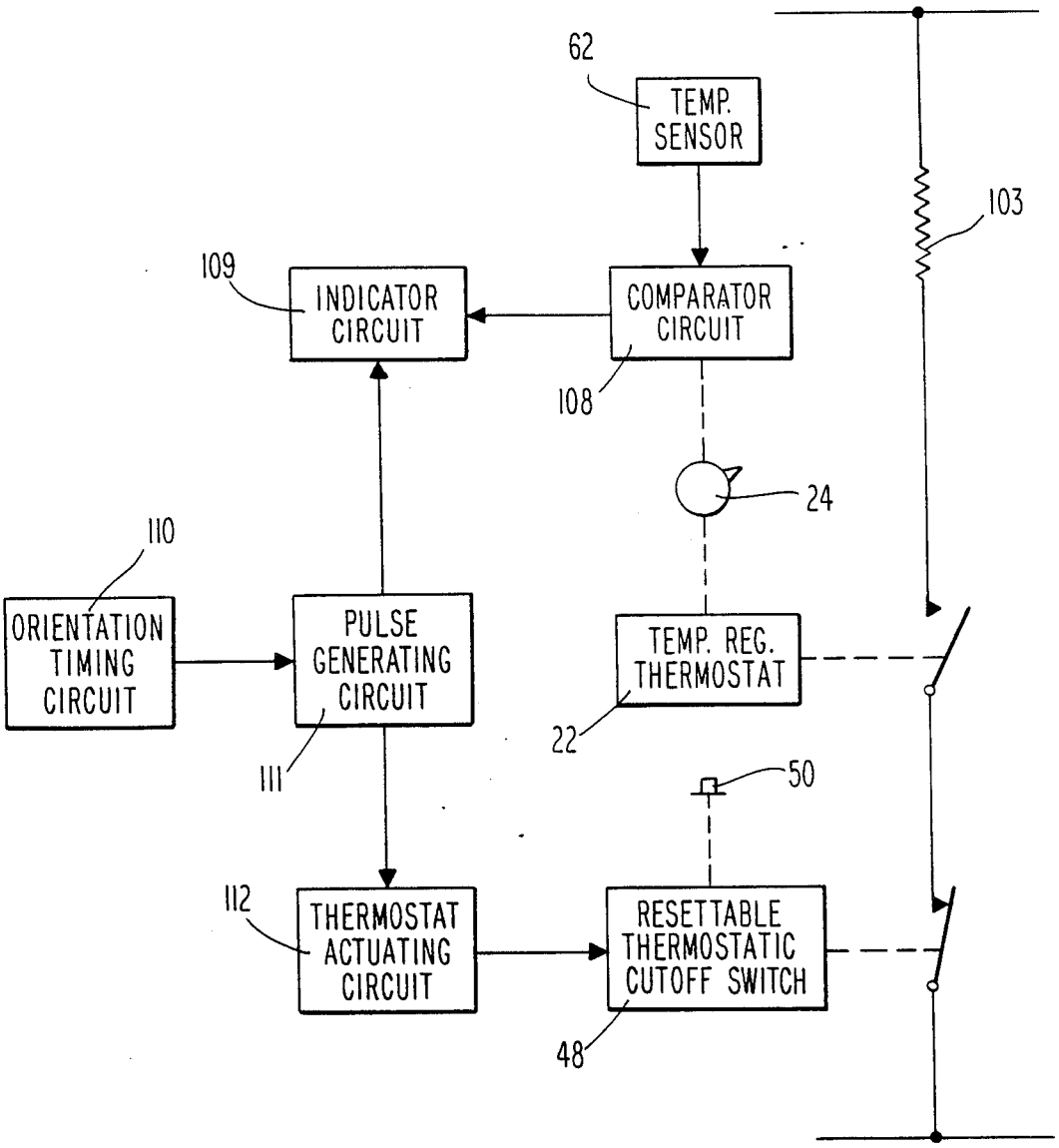
FIG. 5 is a simplified schematic of the functional parts of the control circuit.

Referring to FIG. 5 of the drawing, a simplified schematic of the functional portions of circuit may provide a clearer understanding as to operation of the control circuit 104. The same reference numerals are used in FIG. 4. Setting of the iron temperature by control knob 24 both adjusts the temperature setting on thermostat 22 and potentiometer P1 in comparator circuit 108. Comparator circuit 108 causes the indicator circuit 109 to light the green LED G when the iron temperature is within proper range. The orientation timing circuit 110 provides an output to pulse generating circuit 111 when the iron is left more than 30 seconds in the horizontal position or more than 8 minutes in the vertical position. Pulse-generating circuit 111 causes the indicator circuit 109 to blink the red or green LED, warning that the iron is going to shut off at the same time that it operates the thermostat actuating circuit 112 to provide periodically applied current to the heating resistor in cutoff switch 48. At a preselected temperature, the contacts of the cutoff switch open the circuit which may be manually reset by button 50. While the contacts are closed, temperature on the iron is regulated by thermostat 22 opening and closing the contacts to control the current to the heating element 103.

Operation of the Iron

When the iron is plugged in and with the thermostat 22 at its appropriate setting and the reset button 50*a* pressed so that reset pin 50 assures that the thermostat 48 completes the circuit, the main heating element imbedded in the soleplate 12 is activated. At this point, the power-indicating LED which is preferably yellow illuminates to indicate that there is power and the warming red LED also illuminates to indicate the iron is not at its preset temperature. As the iron eventually heats, the resistor 62 senses the heat adjacent the soleplate and depending on the setting of the potentiometer 28 which parallels the setting of the thermostat 22 when the appropriate equilibrium is reached, the green LED will be illuminated and the red LED simultaneously extinguishes to indicate that the iron is at the preset temperature. In case of overtemperature, the red LED will again light.

The safety positional shutoff and operation will now be described. If the mercury switch senses that the iron is in the horizontal position as shown in FIG. 1 and there is no disturbance of the mercury which might be the case if the iron were being moved, the timing circuitry is initiated. If the pressing iron remains longer than 40 seconds in a horizontal position, or longer than 8 minutes in the vertical position, the orientation timing circuit initiates a visual indication by blinking the red or green LED, whichever happens to be lit. At the same time, the heating resistor 54 is energized with periodically applied current so that the thermostat 48 triggers to cut off the main heating circuit when the heating resistor reaches a preselected temperature.

The signaling means comprise the yellow, red and green LEDS operated as described with the yellow LED indicating power, the red LED meaning an adjustment of the temperature in the iron, and the green LED indicating that the iron is at its preset temperature. The red LED will, light whenever the bias on the potentiometer 28 is such that the sensor 62 is at variance whether the iron is above or below the preset temperature range of the setting. For instance, when it is desired after ironing at a high temperature to reduce the setting of the thermostat to iron rayon, or the like, the red LED will illuminate until the temperature gets down at which time the red light will be extinguished and the green LED will then go on.

In the present invention we have developed an iron having inexpensive components which effectively and automatically shut off the iron if the iron remains stationary in either the horizontal or vertical positions beyond the respective preset times for those positions. Also, the iron of the invention has simple indicating means for indicating the temperature condition of the iron relative to the temperature setting.

Many variations of the structure and circuitry shown can be used in the practice of the invention and thus the invention is not limited to the embodiment shown. The invention may be described in the following claim language.

We claim:

1. An electric pressing iron having a soleplate, a main heating element in the soleplate, a manually resettable thermostatic cutoff switch in series with the heating element, said cutoff switch being manually resettable externally of the iron, a control circuit including a heating resistor mounted on the cutoff switch, an orientation responsive switch and a timing circuit including a capacitor which charges when the circuit is energized, whereby when said orientation responsive switch because of lack of movement of the iron fails to discharge the capacitor for a preset period of time, the heating resistor is activated to trigger said cutoff switch opening the main heating element of the iron.

2. An electric pressing iron as claimed in claim 1 wherein the control circuit includes display means which pulses for a warning period of time prior to the triggering of the cutoff switch.

3. An electric pressing iron having a soleplate, a source of electric power, a main heating element in the soleplate, a manually adjustable temperature-regulating thermostat, a manually resettable thermostatic cutoff switch, both said thermostat and said cutoff switch being connected in series with the heating element to said power source, said cutoff switch including a heating resistor arranged to actuate said cutoff switch to disconnect the heating element, an orientation timing circuit arranged to provide an output when the pressing iron remains in a preselected position for longer than a preselected time, and means responsive to the orientation timing circuit connected to supply power to said heating resistor to actuate said cutoff switch.

4. The combination according to claim 3, including a comparator circuit responsive to iron temperature and to a desired temperature setting, manual control means arranged to simultaneously set said desired temperature in said comparator circuit and on said temperature regulating thermostat, and an indicator circuit having first and second lights, said indicator circuit being connected to the output of said comparator circuit and displaying said first light to show that the iron is within a preselected temperature range of said desired temperature and said second light to show that the iron is above or below said preselected temperature range.

5. The combination according to claim 4, wherein said means responsive to said orientation timing circuit comprises a pulse-generating circuit, having one output connected to said indicator circuit to blink said first and second lights, and having a second output connected to provide current to said heating resistor.

6. The combination according to claim 5, wherein said second output provides a D.C. pulsing current to said heating resistor.

* * * * *